United States Patent [19]

Kaminski et al.

[11] Patent Number: 4,991,613

[45] Date of Patent: Feb. 12, 1991

[54] METHOD FOR STORING A HAZARDOUS LIQUID

[75] Inventors: Frank Kaminski, Churchville; Earl J. Schiffhauer, Rochester, both of N.Y.

[73] Assignee: Eastman Kodak Company, Rochester, N.Y.

[21] Appl. No.: 432,263

[22] Filed: Nov. 6, 1989

[51] Int. Cl.[5] ..... E04H 7/18

[52] U.S. Cl. ..... 137/1; 137/376; 52/194; 206/509; 220/565; 220/429

[58] Field of Search ..... 137/1, 343, 376, 561 R; 220/1 B, 429, 453, 468; 206/509; 52/192, 194

[56] References Cited

U.S. PATENT DOCUMENTS

| | | | |
|---|---|---|---|
| 1,520,230 | 12/1924 | Flath | 52/192 X |
| 2,083,491 | 6/1937 | Chaffee | 52/192 |
| 2,777,295 | 1/1957 | Bliss et al. | 52/192 X |
| 2,931,211 | 4/1960 | McCullough | 52/192 |
| 3,166,511 | 1/1965 | Matsch et al. | 220/429 X |
| 3,481,504 | 12/1969 | Nelson | 220/429 |
| 3,856,178 | 12/1974 | Norgaard | 206/509 X |
| 4,073,976 | 2/1978 | Dudzinski | 220/429 X |
| 4,513,550 | 4/1985 | Kotcharian | 220/435 X |
| 4,594,513 | 6/1986 | Suzuki et al. | 220/468 X |

*Primary Examiner*—John Rivell

*Attorney, Agent, or Firm*—L. George Legg

[57] ABSTRACT

A hazardous liquid, such as a flammable liquid or an explosive liquid, is stored by constructing off-site a transportable module comprising a liquid storage tank mounted within a leak-tight prefabricated, reinforced, concrete vessel. The module is transported to an installation site and supported on a foundation. The space between the storage tank and the vessel is filled with a fire retardant, and then conduits, pumps, etc. are connected to the tank to provide the liquids to, and remove the liquids from, the storage tank.

13 Claims, 2 Drawing Sheets

METHOD FOR STORING A HAZARDOUS LIQUID

BACKGROUND OF THE INVENTION

The invention relates to a method for storing hazardous liquids which is economical, modular and requires less construction at the storage site.

The longstanding rationale to bury storage tanks for flammable liquids is to prevent the propogation of flame or explosion originating in or near one of the tanks in a multi-tank storage facility, and to isolate the storage tank from sources of ignition. Solvent loss due to evaporation is also reduced is the tanks are buried because the tanks are protected from direct sunlight and peak daytime temperatures. The disadvantages of direct burial of the tanks include the need to remove and dispose of large amounts of soil during construction, the difficulty in detecting leakage from the tanks and monitoring ground water contamination, no ground water protection in the event of a rupture or spill, little or no access for maintenance, and higher cost compared to above ground installation of isolated tanks. Also, it is not practical to provide underground storage systems when only temporary storage is needed at a site.

Prior art to deal with the environmental disadvantages include underground basins of concrete or impermeable soil, encasing above ground tank farms in large concrete vaults filled with gravel, compartmentalized buildings with a tank in each compartment, and gravel filled concrete basins on legs or "stilts". All of these approaches are extremely expensive, require ever more careful, extensive, and time consuming site preparation, and are difficult to enlarge or modify once in place. Elaborate means are still required (if feasible) to detect and contain leakage from individual tanks. Also, each installation is unique and requires permits from governmental agencies that are detailed and time consuming to prepare and be approved.

SUMMARY OF THE INVENTION

It is an object of the invention to reduce the cost of storage of hazardous liquids, reduce the delays in constructing a storage system, provide flexibility in layout and use of the available site, provide for secondary containment of a liquid in the event of a leak in the primary containment system for the liquid, and make temporary installations for handling hazardous waste practical.

In accordance with the present invention, a method if provided for the safe and economical storage of a liquid, such as a flammable liquid. The method comprises the steps of constructing off site a transportable module comprising a liquid storage tank mounted within a leak tight prefabricated reinforced concrete vessel. The module is transported to an installation site, and supported on a foundation above grade. The space between the storage tank and the vessel is filled with a fire retardant, and the storage tank is connected to means for providing liquids to, and removing liquids from, the storage tank.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made in the accompanying drawings, in which.

DESCRIPTION OF THE PREFERRED EMBODIMENT

Figure 1:
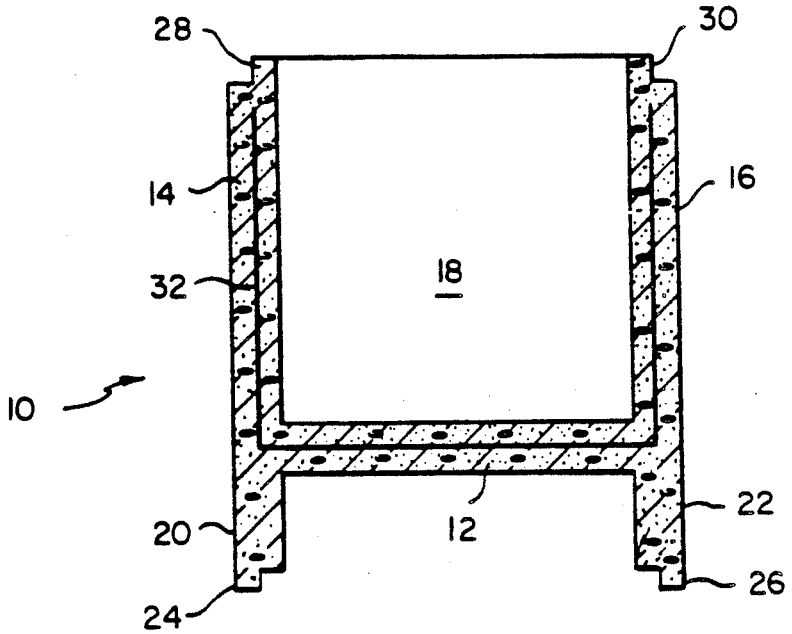
FIG. 1 is vertical cross section of a concrete vessel for secondary containment of liquid.

Referring initially to FIG. 1, the first step in manufacturing a liquid storage system in accordance with the method of the invention comprises the fabrication of a leak-tight, prefabricated secondary containment vessel generally designated 10. The vessel 10 preferably is manufactured from reinforced concrete and has a bottom wall 12, side walls 14 and 16, and two end walls 18 connecting the ends of the side walls, one of such end walls being shown in the drawings. End walls 18 extend upwardly from the bottom wall 12 to the top of the side walls, and the vessel is open at the top. The side walls extend downwardly below the bottom wall 12 to form legs 20, 22 which support the bottom wall 12 above a supporting surface as described in more detail later. The lower end of the legs 20, 22 have a stepped configuration to form a downwardly projecting edges 24, 26 at the bottom of each leg. Similarly, the upper edge of each wall 14, 16 is stepped to form upwardly projecting edges 28, 30. The edges 24, 26, 28 and 30 are arranged so that one vessel 10 can be stacked on top of another vessel (as described later) with the edges 24, 26 being just outside of the edges 28, 30, respectively.

Since the vessel 10 is part of a system that is especially desirable for storing liquids, it is preferred that the vessel 10 be capable of containing liquids that may be spilled from the primary container described later. For this to be accomplished, it is preferred that a liquid tight membrane 32 be located within the bottom wall 12, side walls 14, 16 and end walls 18 of the vessel.

Figure 2:
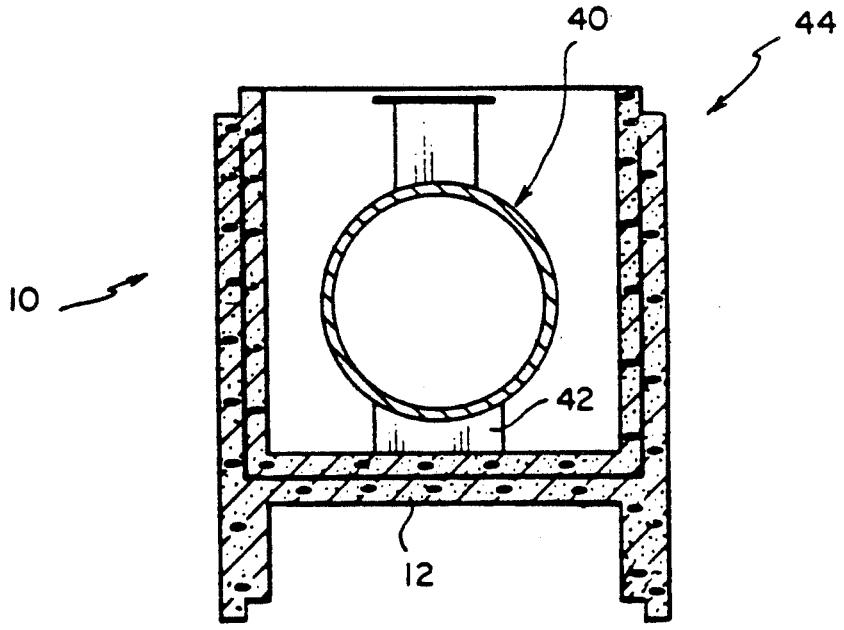
FIG. 2 is a vertical cross-section view through a transportable module constructed off site and comprising a storage tank within the concrete vessel of FIG. 1.

Referring now to FIG. 2, the next step in the manufacture of the storage system is the mounting of a liquid storage tank 40 within the vessel 10. The tank can be made of a metal, plastic, glass, etc., and can be lined with a material that is resistant to the liquid to be stored in the tank. Tank 40 may comprise a cylindrical tank, for example, and be positioned within the vessel by mounting it on a support 42 that is secured to the bottom wall 12 of the vessel and has a semi-cylindrical upper surface for receiving the lower portion of the tank 40. Preferably the support 42 is rigidly secured to both the tank 40 and to the bottom wall 12 of the vessel so that the tank and vessel together comprise a module generally designated 44 that can be transportable from a construction site and interchangeable with other similar modules 44.

Preferably the modules 44 are constructed in a shop or a factory where they can be economically mass produced on an assembly line basis in an efficiently designed manufacturing area. Similarly, it is preferred that modules 44 be made in standard sizes for containing a specific amount of liquid as, for example, 1000, 5,000, 10,000 or 20,000 gallon capacities. This will enable the modules to be manufactured and inventoried for shipment to a construction site when needed and will enable the rapid on site deployment of such a module in the event a leaking tank is discovered at the storage site. Modules 44 are easily transportable to the storage site on a trailer, for example.

Figure 3:
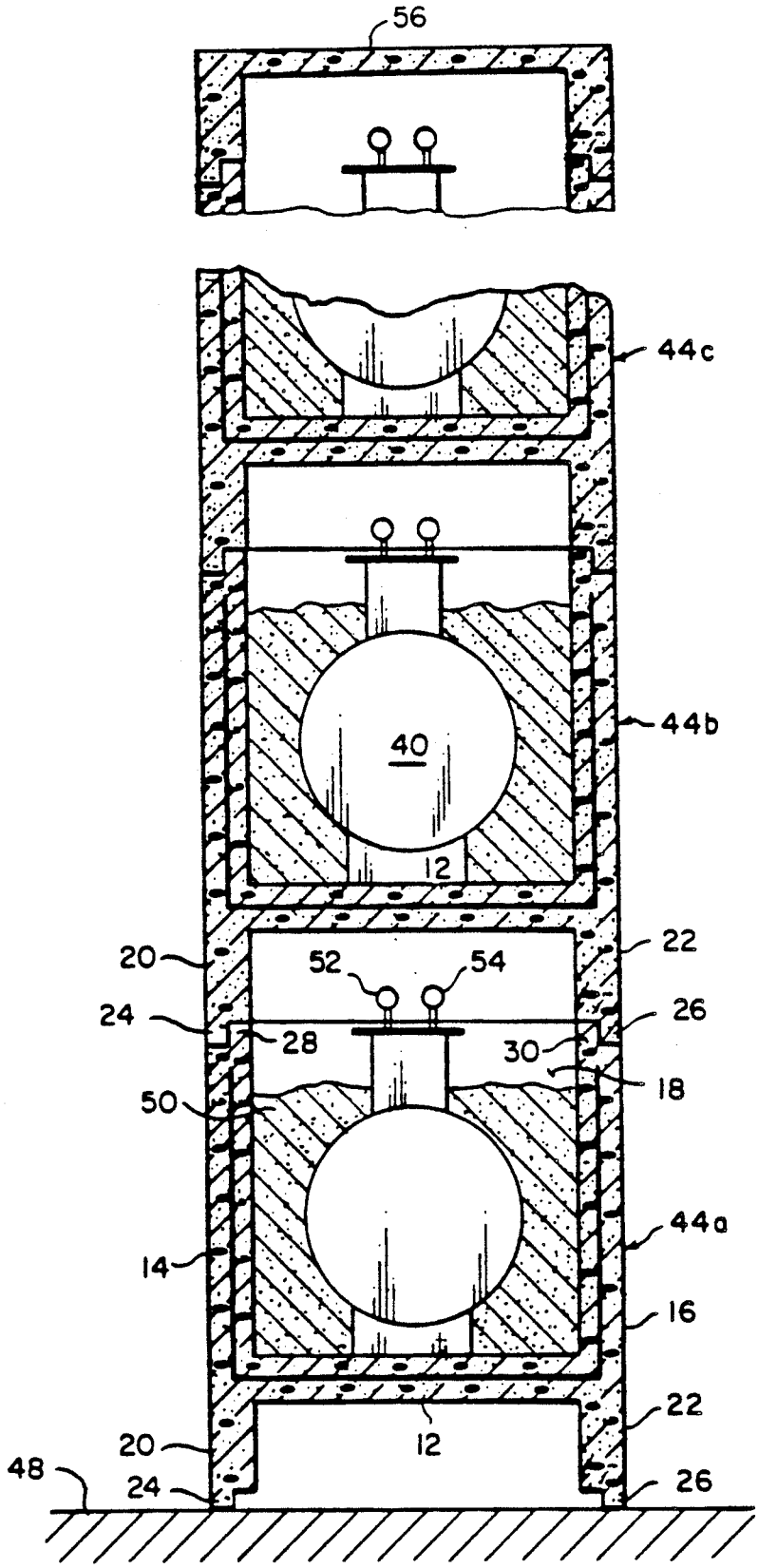
FIG. 3 is a view showing a plurality of modules for containing hazardous liquids, as shown in FIG. 2 installed at a site.

Referring to FIG. 3, the site where the liquids are to be stored is prepared for receiving modules 44 by constructing a foundation or support slab 48 at the site and preferably above grade. While the modules could be located below ground, as with conventional storage systems, the apparatus of the present invention can be, and preferably, is located at or above grade. The foundation or slab 48 can be constructed on site or may be a prefabricated section of reinforced concrete that is transported to the site when the storage system is to be constructed.

When modules 44 are received at the site, one of the modules is placed directly on the foundation 48 as shown in FIG. 3 for the module designated 44*a*. The feet 20, 22 rest directly on the foundation 48 and serve to support the module 44*a* in place on the foundation. The legs 20, 22 of the module support the bottom wall 12 above the foundation 48 by a distance sufficient to enable visual inspection of the area beneath the bottom wall 12 to determine if the module is leaking liquid after it has been installed and contains liquid. When module 44*a* is in place, the space around the tank 40 and within the vessel 10 is filled completely with a loose fill 50, such as pea gravel, which inhibits fire and explosion of any liquids that might leak from the tank 40. The addition of pea gravel or similar fill is important for above grade storage of flammable liquids since it effectively prevents explosion and fire and thus makes above grade storage safe.

Next, conduits 52, 54 are connected to the tank 40 at the top of the tank as illustrated in FIG. 3. The conduits extend above the end walls 18 of vessel 10 and can pass through the ends of the vessel 10 over the top of the end walls. Pumps (not shown) are connected to the conduits for providing liquids to, and removing liquids from, the tank 40.

Next, a second module 44*b* is placed on top of the module 44*a* with the edges 24, 26 of module 44*b* mating with the edges 28, 30 of module 44*a*. These interlocking edges simplify and facilitate stacking of the modules and avoids inadvertent lateral movement of one module relative to the other. The legs 20, 22 of module 44*b* support the bottom wall 12 of module 44*b* above the conduits 52, 54 of the module 44*a* and provide a space at the end of the stack through which the conduits can project without modification of the modules themselves. This space between the bottom wall 12 of module 44*b* and the top of module 44*a* also enables visual inspection of the area to detect leaks in the module 44*b* or in the conduits 52, 54.

When module 44*b* is firmly in place, fire retardant, such as loose fill or pea gravel 50, can also be provided in module 44*b* around tank 40, and then conduits 52, 54 connected to the tank 40 of the module 44*b*. Additional modules can be located above module 44*b*, as shown by a module 44*c* in FIG. 3. Preferably, the top of the uppermost module is enclosed with a suitable cover 56 (FIG. 3). The cover prevents water from rain or snow from infiltrating the system.

Additional stacks of modules 44 can be located on the foundation or slab 48 alongside module 44*a*. When one or more stacks of modules are provided alongside module 44*a*, the stacks of modules can be staggered or offset relative to each other. The modules of one stack also can be secured to the adjacent modules of another stack to improve the structural stability of the assembly of modules and thus enable higher stacking of the modules. Thus a vertically arranged "tank farm" is provided consisting of multiple modules of a uniform design that can be economically fabricated off site, transported to the liquid storage site and quickly assembled. The modules provide fire and explosion resistance, visual inspection for leaks, and easy replacement of modules that may leak.

The storage system comprises a plurality of the modules stacked one above the other on a foundation at grade level with each module comprising a liquid storage tank mounted within a leak-tight prefabricated, reinforced concrete vessel that is interchangeable with and stackable with other similar vessels. The system has space provided by legs 20, 22 for visual inspection for leakage past the secondary containment vessel 10, and space for installation of conduits 52, 54 and other means for providing liquid to the tanks and removing it from the tanks. The use of a fire retardant 50 makes installation above grade level feasible for flammable material.

There are a number of advantages of the method of the invention over prior methods. One advantage is that costs are greatly reduced because modules for primary and secondary containment of liquids can be mass produced in an assembly line mode in a shop efficiently designed for the manufacture of same. Costs are further reduced because the prefabricated units have structural integrity, thereby reducing the need for massive and elaborate in situ supports.

Delays due to the need to obtain permits for excavation and soil disposal work plans are eliminated because excavation is minimized and extensive deep foundations are not as necessary. Design is standardized thereby posing less uncertainty and risk to the public and regulatory community. A standardized design also reduces costs and facilitates approvals from regulatory agencies.

Installation is very rapid because major components may be marshalled offsite and installed quickly when needed. Installation time can be reduced from months to weeks.

Great flexibility is now permitted in layout and use of existing real estate. Irregularly shaped footprints for the stack of modules are easily installed without resorting to elaborate foundation and structure (as for a building designed to fit within a cramped site).

Above ground secondary containment becomes economically feasible for municipalities, gasoline stations, small processors and others, thereby removing many more potential environmental damage points. Also, temporary installations become practical. In addition, tank farms are easily moved, altered, or enlarged, and a defective (leaking) module is easily detected and replaced.

The invention has been described in detail with particular reference to a preferred embodiment thereof, but it will be understood that variations and modifications can be effected within the spirit and scope of the invention.

What is claimed:

1. A method for the safe and economical storage of liquids, comprising the steps of:

constructing off site a plurality of transportable modules with each module comprising (1) a liquid storage tank mounted within (2) a leak tight prefabricated reinforced concrete vessel that is interchangeable with and stackable with other similar vessels, each vessel having a bottom wall, side walls, end walls, legs projecting below the bottom wall and being open at the top, transporting the modules to an installation site, placing one of the modules on a foundation with the legs of the vessel of such module supporting the module above the foundation by a distance to enable visual inspection for leaks between the bottom wall of such module and the foundation, above grade, stacking a second module on said one module with the legs of the second module resting on the side walls of said one module and with the bottom wall of the second module closing the top of said one module, filling the space between the storage tanks and the vessels with a fire retardant, and connecting conduits to the storage tanks so that the liquid can be provided to and removed from, the storage tanks.

2. A method as set forth in claim 1, further comprising placing a cover over the second module.

3. The method of claim 1 wherein said fire retardant is pea gravel.

4. A method for the safe and economical storage of a liquid, comprising the steps of:

constructing off site a plurality of transportable modules with each module comprising a liquid storage tank mounted within a leak tight prefabricated vessel that is stackable with other similar vessels, transporting said modules to an installation site, placing one of said modules on a foundation with the legs of said vessel of said module supporting said module above the foundation by a distance to enable visual inspection for leaks between the bottom wall of said module and said foundation, above grade, stacking an additional similar module on said one module, filling the space between each said storage tank and the associated vessel with a fire retardant, and containing said liquid in each said module.

5. The method of claim 4 wherein said prefabricated vessel is reinforced concrete.

6. The method of claim 4 further comprising the step of connecting to each storage tank means for providing liquids to, and removing liquids from, each said storage tank.

7. The method of claim 6 wherein said means for providing and removing liquids is a conduit.

8. The method of claim 4 wherein said fire retardant is pea gravel.

9. A method for the safe and economical storage of a liquid, comprising the steps of:

constructing off site a transportable module comprising a liquid storage tank mounted within a leak tight prefabricated vessel that is stackable with other similar vessels, transporting said module to an installation site, placing said module on a foundation with the legs of said vessel of said module supporting said module above said foundation by a distance to enable visual inspection for leaks between the bottom wall of said module and said foundation, above grade, filling the space between said storage tank and said vessel with a fire retardant, and containing said liquid in said module.

10. The method of claim 9 wherein said prefabricated vessel is reinforced concrete.

11. The method of claim 9 further comprising the step of connecting to said storage tank means for providing liquids to, and removing liquids from, said storage tank.

12. The method of claim 11 wherein said means for providing and removing liquids is a conduit.

13. The method of claim 9 wherein said fire retardant is pea gravel.

* * * * *